US005619767A

United States Patent [19]

Larson

[11] Patent Number: 5,619,767

[45] Date of Patent: Apr. 15, 1997

[54] TARGETABLE-ACTION STATIONARY POT-SCRUBBING MACHINE

[76] Inventor: Mark C. Larson, 516 Stevens Dr. #108, Addison, Ill. 60101

[21] Appl. No.: 543,413

[22] Filed: Oct. 16, 1995

[51] Int. Cl.[6] ..... A47L 15/00; A47L 17/02

[52] U.S. Cl. ..... 15/74; 15/23

[58] Field of Search ..... 15/75, 74, 71, 15/70, 69, 68, 67, 66, 65, 88, 56, 57, 59, 22.1, 22.2, 22.4, 23; 4/606, 628; 134/6, 25.2

[56] References Cited

U.S. PATENT DOCUMENTS

| | | | |
|---|---|---|---|
| 602,190 | 4/1898 | Evans . | |
| 620,250 | 2/1899 | Pira . | |
| 866,019 | 9/1907 | Handel | 15/22.2 |
| 1,256,002 | 2/1918 | Farrar . | |
| 1,414,634 | 5/1922 | Fassio | 15/23 |
| 1,415,689 | 5/1922 | Parent | 15/23 |
| 1,462,598 | 7/1923 | Grenzke . | |
| 1,757,909 | 5/1930 | Kazazian . | |
| 1,831,684 | 11/1931 | Petersen . | |
| 1,876,895 | 9/1932 | Fleming . | |
| 1,927,917 | 9/1933 | Canfield | 15/75 |
| 1,951,273 | 5/1934 | Dalgleish . | |
| 2,019,705 | 5/1935 | Hubert . | |
| 2,104,272 | 1/1938 | Partridge . | |
| 2,445,707 | 7/1948 | Brown et al. . | |
| 2,563,528 | 8/1951 | Hamilton | 15/75 |
| 2,579,393 | 12/1951 | Modrey . | |
| 2,631,313 | 3/1953 | Webber | 15/75 |
| 2,869,794 | 1/1959 | Modrey . | |
| 2,944,271 | 7/1960 | Foster et al. | 15/56 |
| 3,011,192 | 12/1961 | Delamater | 15/74 |
| 3,014,229 | 12/1961 | Fassio | 15/23 |
| 3,121,897 | 2/1964 | Lambrich | 15/74 |
| 3,947,909 | 4/1976 | Kuo | 15/23 |
| 4,168,559 | 9/1979 | Henson | 15/23 |
| 4,228,559 | 10/1980 | Kirk | 15/75 |
| 5,156,634 | 10/1992 | Yang | 15/75 |
| 5,315,729 | 5/1994 | Yang | 15/75 |

FOREIGN PATENT DOCUMENTS

| | | | |
|---|---|---|---|
| 429892 | 10/1911 | France | 15/23 |
| 1037051 | 4/1953 | France | 15/74 |
| 687379 | 2/1953 | United Kingdom | 15/74 |

*Primary Examiner*—David Scherbel
*Assistant Examiner*—Tony G. Soohoo

[57] ABSTRACT

A ultrastreamlined, adaptable, stationary pot-scrubbing machine comprising a motor positioned in any desirable location beneath a sink, a flexible shaft coupled with the motor, a positioning neck comprising an arched tube rotatably mounting a scrubbing member in a substantially vertical or downturned position for the scrubbing axis and internally housing the flexible shaft to couple with the scrubbing member, and a base supporting the positioning neck adjacent to the sink, whereby said stationary pot-scrubbing machine is adaptable to any sink, and permits pots and pans to be cleaned in an upright, unobstructed manner, visible to the user so particular food deposits can be targeted for scrubbing.

10 Claims, 2 Drawing Sheets

TARGETABLE-ACTION STATIONARY POT-SCRUBBING MACHINE

BACKGROUND OF THE INVENTION

Often, apartment dwellers cannot afford a traditional dishwasher or simply cannot install one due to limited space. The traditional dishwasher is large, expensive, and unsuitable for scouring purposes. Considering the fact that there is no other household chore performed more frequently than washing dishes, the dishwashing market clearly has room for more variety. The present invention relates to a dish scrubbing machine and more specifically an ultrastreamlined, targetable-action adaptable pot-scrubbing appliance.

There have been a number of dish scrubbing machines developed. These fall into two categories: hand-held dish scrubbing machines and stationary dish scrubbing machines. Hand-held machines rely on the movement of the scrubbing member to isolate particular food deposits. The advantage of hand-held variations is versatility, where specific food deposits can be isolated and scrubbed. The main disadvantage of hand-held variations is that they require a single-handed hold on the dish or pan being scrubbed. This one-handed hold can be a struggle on a slippery sink with no good place to brace the pan.

Stationary dish scrubbing machines rely on the movement of the dish itself to operate, requiring the dish to be maneuvered against a stationary scrubbing member to remove particular food deposits. The advantage of this that a utensil can be held with both hands during scrubbing. The disadvantage is lack of what might be called "targetability," where particular food deposits cannot be "targeted" during scrubbing because either 1) the utensil simply cannot be freely maneuvered against the scrubbing member due to obstructions, and/or; 2) the surface of the utensil is not even visible during scrubbing. Both of these factors are needed for targetability.

Examples of stationary dish scrubbing machines are U.S. Pat. Nos. 5,315,729, 4,228,559, 3,121,897, 3,011,192. Some of these devices are located at the bottom of the sink basin, on the faucet, or just next to the sink extending horizontally over the sink among other places. These positions require the user to turn the dish down or away from him or herself resulting in "blind" washing. Some positions allow the sink structure to interfere with the size and shape of utensils that can be washed. For example, if the scrubber is located on the faucet, the angle of most faucet necks would hit the side of a large pan or plate, preventing it from being washed properly. If the scrubber is located near the sink basin walls, this would likewise prevent a large pan from being maneuvered freely against the scrubber.

Another problem with stationary dish scrubbing machines is that they are bulky, and awkward to mount on a common kitchen sink in a strong but aesthetic manner. The surface structures of the machine should be streamlined, using measures such as eliminating unnecessary structural features, and remotely powering the scrubbing member from a motor below the sink. However, there are many obstacles below a sink, and above the sink the scrubbing axis requires realigning. Therefore, a stationary dish scrubbing machine should also be adaptable to different configurations. All these considerations must be met without losing the strength to scour pots and pans because this is the niche that the traditional automatic dishwasher does not fill.

SUMMARY OF THE INVENTION

One object of the present invention is to develop a method whereby the rotary scrubbing member could be powered from a non-aligned power source.

Another object of the present invention is to develop a stationary pot scrubbing machine which has "targetable-action."

Another object of the present invention is to develop a pot scrubbing machine where the utensil can be scrubbed holding the utensil with both hands.

Another object of the present invention is to utilize a ultrastreamlined surface structure with minimized bulk to support the rotatable scrubbing member above the sink without losing strength or functional capability.

Another object of the present invention is to develop a versatile pot scrubbing machine adaptable to any sink and to any desirable scrubbing position.

Another object of the present invention is to develop a pot scrubbing machine where the motor can be safely positioned away from the dishwater of the sink.

Another object of the present invention is to be capable of scrubbing a wide variety of utensil shapes and sizes unobstructed by other structures of the sink.

Another object of the present invention is to fill the need for a pot scrubbing machine strong enough to clean difficult deposits which a traditional dishwasher cannot.

Another object of the present invention is to be capable of "impulse" operation, where a single pot can be cleaned immediately without reaching to turn a switch on or off.

The foregoing objectives can be accomplished by incorporating realignment means such as a flexible drive shaft into a pot scrubbing machine and mounting the scrubbing member rotatably on a positioning neck, or extension device which can be custom shaped to hold the scrubbing member in any desirable position above the sink such as a down-turned-axis position for targetable scrubbing. This method enables a pot scrubbing machine to be tailored to almost any need. First, a desirable location for the motor must be determined, like beneath the sink so it will not create interferences or potential hazards in sink area. Then, a desirable position for the scrubbing member must be determined, like, for example, a vertical position above the sink. Finally, a structural path for the flexible shaft connecting these two locations, and positioning the scrubbing member, must be constructed. This primarily involves the positioning neck. The positioning neck is a structure of rigid material such as metal tubing comprising various shapes suitable for mounting the scrubbing member above the sink vertically, horizontally, or in any desirable position through rotatable means. The positioning neck then mounts in a base adjacent to the sink basin, preferably located on the apperture normally used for a spray hose device so the flexible shaft can travel through it. The flexible shaft then couples with the motor, and travel through the positioning neck to the scrubbing member, transmitting rotary power to the scrubbing member. Finally, the electric motor connects to a foot switch for impulse operation.

DETAILED DESCRIPTION OF THE PREFERRED EMBODIMENTS

Figure 1:
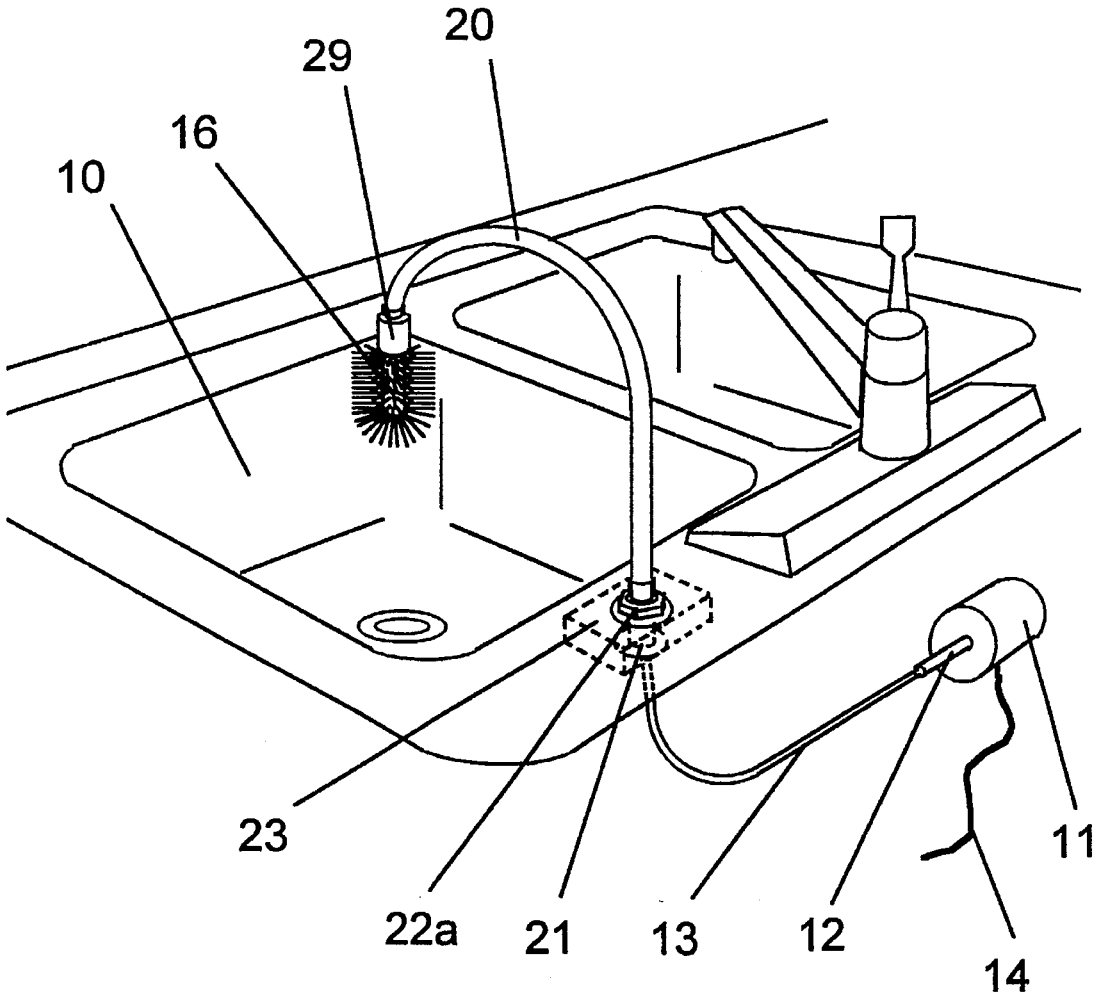
FIG. 1 is a rear, cutaway perspective of a kitchen sink with a vertical dish scrubbing machine embodiment attached thereto.

Referring to FIG. 1, therein illustrated is a rear, cutaway, perspective of a kitchen sink 10 mounted with an ultras-treamlined, targetable-action, adaptable pot scrubbing machine using the present method which is generally comprised of gear-reduced electric motor 11, insulator coupling 12, flexible shaft 13, power cord leading to a conventional foot-operated switch (not pictured) 14, positioning neck components including a tubular shaft housing 20, bearing housing 29 and scrubbing member 16; and base components including shaft housing socket 21, support plate 23, and mounting nut 22*a*. The first step in this method for constructing this pot scrubbing machine is to mount the motor in any desirable position. In this embodiment, electric motor 11 is mounted by fastening means beneath the kitchen sink 10 horizontally between the rear wall and the side wall of the sink basins 10 running parallel to real wall, with drive shaft directed toward the vertical apperture often used for a spray hose device. This location is chosen to avoid potential water dripping, to align with the passage which the flexible shaft will travel through, and to convey the power cord 14 and foot switch to a desirable location. Electric motor 11 connects with a conventional foot-operated on/off switch (not pictured) in front of the sink 10 for impulse operation. The second step in this process is to construct a positioning neck of any desirable shape and size to support the scrubbing member 16 in a predetermined position such as vertical or downturned in this embodiment, and for conveying flexible shaft 13 to scrubbing member 16. The positioning neck includes a tube or shaft housing 20 which is comprised of rigid tubing shaped in a 180 degree arc designed to suspend scrubbing member 16 vertically above the sink, and a bearing housing 29 for rotatable mounting scrubbing member 16. The positioning neck is explained in more detail in the following paragraphs. The third step is to construct a base for the positioning neck in a predetermined location, and permanence. In this embodiment the base is a permanent fixture mounted on the apperture normally used for a spray hose device so the flexible shaft 13 can travel through the base. The positioning neck inserts into the cylindrical shaft housing socket 21 which is permanently mounted through the sink with mounting nuts 22*a* & 22*b* and support plate 23. The base is explained in more detail in the following paragraphs. The final step in constructing this pot scrubbing machine is to convey the flexible shaft 13 from the motor 11 to the scrubbing member 16. In this embodiment, the shaft of electric motor 11 couples with short insulator coupling 12 consisting of a non-conducting material to prevent electricity conducting through flexible shaft 13. Insulator coupling 12 couples with a partially-encased (i.e. just the ends of shaft expose the core) flexible shaft 13 constructed of helically-wound wire. The flexible shaft 13 permits the pot scrubbing machine to adapt to a non-aligned layout by traveling internally through the shaft housing 20 of the positioning neck to the scrubbing member 16.

Figure 2:
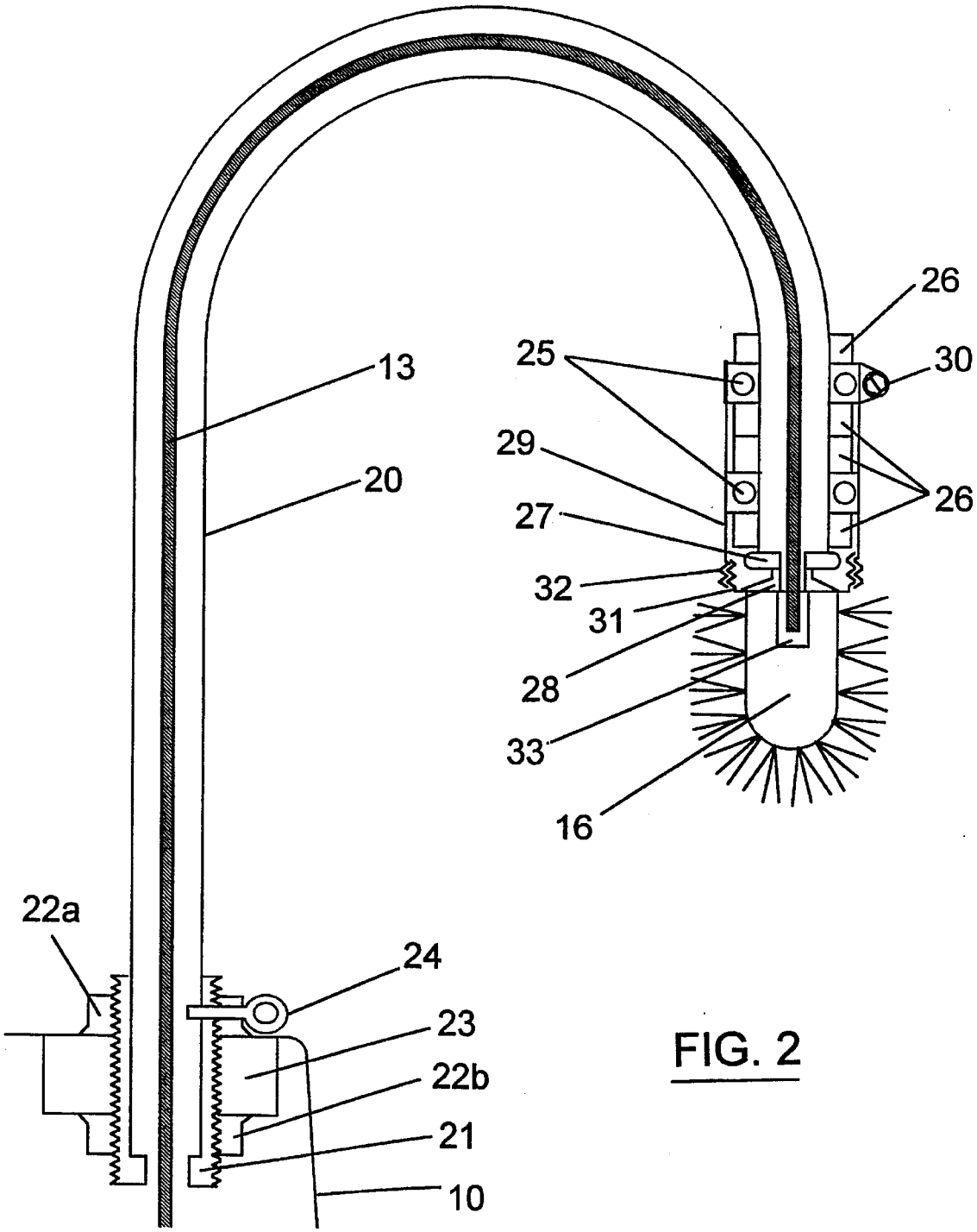
FIG. 2 is a cross-section perspective of the base and positioning neck of a vertical scrubbing machine embodiment.

Referring to FIG. 2, the vertical positioning neck embodiment is comprised of the tubular shaft housing 20, radial bearings 25, thrust collars 26, plastic thrust bearing 27, scrubbing member fastener 28, bearing housing 29, band clamp 30, male scrubber coupling 31, female scrubber coupling 32, and flexible shaft fitting 33. The base is comprised of the shaft housing socket 21, nuts, 22*a* and 22*b*, mounting support plate 23, and locking pin 24. The shaft housing socket 21 is an externally threaded rigid cylindrical sleeve vertically intersecting sink structure 10 containing a partial barrier on the bottom inner wall of the shaft housing socket to maintain the elevation of the shaft housing 20 without constricting flexible shaft 13. Mounting nuts 22*a* & 22*b* and support plate 23 fasten shaft housing socket 21 vertically through sink structure 10. Swivel locking pin 24 fits through a hole above sink structure 10, intersecting horizontally through mounting nut 22*a*, shaft housing socket 21, and shaft housing 20, enabling positioning neck to lock in operating position when in use. The positioning neck is comprised of shaft housing 20 for housing the flexible shaft, and bearing means for rotatably mounting scrubbing member 16 on the shaft housing 20. Shaft housing 20 in this embodiment consists of rigid tubing comprising a "goose-neck faucet" shape of a substantially 180 degree arch extending between two substantially vertical, parallel, straight portions of tubing of differing lengths, where the longer straight portion inserts into the shaft housing socket 21 and the shorter portion serves as the mounting site for the scrubbing member 16 suspended substantially vertically over the center of sink 10, while internally housing and realigning flexible shaft 13 to couple with vertical scrubbing member 16. The longer end of shaft housing 20 fits into the vertically aligned shaft housing socket 21 with a rotatable tolerance to permit swiveling. Two radial bearings 25 are fitted outside the shorter end of shaft housing 20 to direct the rotary motion of scrubbing member 16. Four thrust collars 26 hold radial bearings in place by fastening to shaft housing 20 above and below each bearing. Bearing housing 29 comprises a cylindrical sheet metal enclosure of radial bearings 25 extending vertically down beyond the end of shaft housing 20 and fastening to plastic threaded male scrubber coupling 31. Band clamp 30 clasps top end of bearing housing 29 around radial bearings 25. Plastic threaded female scrubber coupling 32 fastens to scrubbing member 16 by scrubbing member fastener 28. This enables scrubbing member 16 to be detachably connected to male scrubber coupling 31 and flexible shaft 13 detachably inserted within scrubbing member 16 by the press-fitted flexible shaft fitting 33. This embodiment is designed to permit a cooking utensil to be scrubbed in a similar way to hand-washing, i.e. in a visible, upright fashion, unobstructed by the position of the cooking utensil.

In use, a person moistens a cooking utensil in any convenient manner (such as with a manual pump-type dispenser containing soapy water), then holds moistened cooking utensil in contact with scrubbing member. Electric motor 11 is activated by foot switch causing electric motor 11 to run at low RPM and high torque due to gear reduction. The combination of low RPM and foot pedal operation prevents splashing of scrubbing member, and overheating of motor. Insulator shaft 12 transmits rotation and prevents conducting of electricity through flexible shaft 13 to user. Flexible shaft 13 transmits rotary power along curved path through sink 10 and shaft housing 20 to scrubbing member 16. Scrubbing member then spins and allows cooking utensil to be maneuvered against it for cleaning. Shaft housing socket 21 holds shaft housing 20 firmly during scrubbing while permitting shaft housing 20 to swivel when not in use if swivel locking pin 24 is removed.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. Many other variations are possible.

Accordingly, the scope of the invention should be determined not by the embodiments illustrated, but by the appended claims and their legal equivalents.

I claim:

1. A targetable action, stationary, pot scrubbing machine mounted on a common kitchen sink comprising:

a scrubbing member comprising a round shape suitable for rotary scrubbing of cooking utensils;

a positioning neck comprised of rigid tubular material of a substantially arched shape rotatably mounting the scrubbing member above said kitchen sink in a suspended, stationary manner with a substantially downturned scrubbing axis suitable for maneuvering cooking utensils against said scrubbing member in an upright manner exposing the utensil surface, and also housing power transmission means;

a base supporting the positioning neck in a substantially vertical position adjacent to the sink;

a motor mounted in a predetermined location;

and power transmission means coupling said motor with said scrubbing member for transmitting rotary power to the scrubbing member;

whereby large cooking utensils can be held with both hands and freely maneuvered against the scrubbing member targeting particular food deposits in the line of sight of the user.

2. The targetable action, stationary, pot scrubbing machine of claim 1 wherein said motor comprises, a motor mounted beneath the sink in a predetermined location suitable for transmitting power through an aperture adjacent the sink, whereby the motor is concealed and the surface structures of the pot scrubbing machine are reduced.

3. The targetable action, stationary, pot scrubbing machine of claim 1 wherein said base comprises, a permanent fixture mounted through an aperture adjacent the sink, suitable for mounting the positioning neck in an upright position.

4. The targetable action, stationary, pot scrubbing machine of claim 1 wherein said power transmission means comprises, a flexible shaft coupling the motor with the scrubbing member to cause rotation of the scrubbing member.

5. An ultra-streamlined, stationary, pot scrubbing machine mounted on a kitchen sink comprising:

a motor mounted in a predetermined location beneath said sink:

a scrubbing member comprising a round shape suitable for rotary scrubbing of cooking utensils:

a positioning neck comprised of a rigid tubular structure of a predetermined degree of curvature along the length of the tubular structure and suitable for rotatable mounting the scrubbing member above the sink and for partially housing a flexible shaft;

a base supporting the positioning neck in a substantially vertical position adjacent to the sink;

said flexible drive shaft coupling the motor with the scrubbing member for transmitting rotary power to the scrubbing member;

whereby said positioning neck provides a nonobstructive, strong and aesthetic support for the scrubbing member, omitting unnecessary bulk, and permitting large utensils to be freely maneuvered against the scrubbing member using both hands.

6. The ultrastreamlined, stationary, pot scrubbing machine of claim 5 wherein said positioning neck comprises, a tubular structure comprising an arched shape suitable for rotatably mounting the scrubbing member above the sink in a stationary manner with a downturned scrubbing axis suitable for scrubbing cooking utensils in an upright position.

7. An adaptable, stationary, pot scrubbing machine comprising, a motor mounted in a desired location proximate to a kitchen sink;

a positioning neck of a rigid arch shaped tubular structure rotatably mounting a scrubbing member over the sink, and suitable for housing a flexible shaft; and a base adjacent to the sink supporting the positioning neck; and said flexible shaft coupling the motor with the scrubbing member to cause rotation of the scrubbing member.

8. The adaptable, stationary, pot scrubbing machine of claim 7 wherein said positioning neck mounts the scrubbing member in a downturned position suspended over the sink.

9. The adaptable, stationary, pot scrubbing machine of claim 7 wherein the motor comprises, a motor mounted beneath the sink in a predetermined location for transmitting power through an aperture adjacent the sink.

10. A method for adapting a flexible shaft machine to stationary scrubbing of pots and pans comprising, mounting a motor in a predetermined location relative to a kitchen sink;

constructing a positioning neck comprised of rigid tubular material of a substantially arched shape rotatably mounting the scrubbing member above said kitchen sink in a suspended, stationary manner with a substantially downturned scrubbing axis suitable for maneuvering cooking utensils against said scrubbing member in an upright manner exposing the utensil surface, and also housing power transmission means;

rotatably mounting a scrubbing member on said positioning neck comprising a round shape suitable for rotational scrubbing of cooking utensils;

mounting the positioning neck adjacent to the sink with structural means in a substantially upright position on the vertical aperture adjacent to the sink;

and coupling said motor with said scrubbing member with a flexible shaft for transmitting rotational power to the scrubbing member;

whereby the stationary pot scrubbing machine is adaptable to various configurations.

* * * * *